United States Patent [19]

Lacam et al.

[11] Patent Number: 4,819,610

[45] Date of Patent: Apr. 11, 1989

[54] DEVICE FOR FEEDING WEAPONS WITH COMPRESSED GAS

[75] Inventors: Jean S. Lacam; René E. Pons, both of Saint-Etienne; Pierre J. Simand, Saint-Marcelin, all of France

[73] Assignee: Etat Francais, Paris, France

[21] Appl. No.: 945,521

[22] Filed: Dec. 23, 1986

[30] Foreign Application Priority Data

Dec. 27, 1985 [FR] France ..... 85 19282

[51] Int. Cl.[4] ..... F41B 11/06

[52] U.S. Cl. ..... 124/75

[58] Field of Search ..... 124/69, 71, 72, 73, 124/74, 75, 76, 77

[56] References Cited

U.S. PATENT DOCUMENTS

| | | | |
|---|---|---|---|
| 1,506,995 | 9/1924 | Paul | 124/69 |
| 2,525,082 | 10/1950 | Sherman | 124/75 |
| 2,817,328 | 12/1957 | Gale | 124/76 |
| 2,881,752 | 4/1959 | Blahnik | 124/69 |
| 3,572,310 | 3/1971 | Chiba | 124/76 |
| 3,756,284 | 9/1973 | Breunich | 124/73 |

FOREIGN PATENT DOCUMENTS 1113966 12/1955 France .

*Primary Examiner*—Richard J. Johnson
*Assistant Examiner*—Michael Brown
*Attorney, Agent, or Firm*—Parkhurst, Oliff & Berridge

[57] ABSTRACT

The invention relates to a device for feeding with compressed gas a weapon of the type including a gas reserve, a valve that can move inside a valve housing and a valve seat located in this housing, holding and guiding a valve rod. This device includes an expansion unit interposed between the gas reserve and the valve, consisting of a first expansion chamber communicating with the gas reserve and a second chamber, the chambers being separated by a calibrated orifice. The volume of the second chamber is smaller than that of the first chamber. Both chambers are delimited by hollow cylindrical elements, the cylinder which constitutes the second chamber projecting into the valve housing, its end constituting the valve stop so that the distance between the stop of the seat and the valve stop determines the valve stroke. The motive power that closes the valve consists of the reaction force generated by the impact of the valve against the stop, on the one hand, and of the compressed gas pressure, on the other hand.

9 Claims, 4 Drawing Sheets

DEVICE FOR FEEDING WEAPONS WITH COMPRESSED GAS

BACKGROUND OF THE INVENTION

The technical sector of the present invention is that of the devices used for firing various projectiles by means of a compressed gas.

To feed firing apparatuses such as weapons with compressed gas, a well known method consists in using valves or obstructors, located in a pipe, actuated by a percussion hammer so as to deliver a quantity of compressed gas required for launching a projectile. In most cases, a spring is used for returning the valve to its original position in order to provide for circuit tightness. As an illustration, the following patents may be mentioned: U.S. Pat. Nos. 3,527,194, 3,741,189, 2,940,438, 2,817,328, 4,116,193 and 4,602,608. This spring must be calibrated so as to take gas pressure into account and it is difficult to obtain an approximately constant quantity of gas, in order to avoid a too large dispersion upon firing. Thus, the use of this spring imposes some constraints and, moreover, in case of breaking, requires a complete disassembly of the weapon or apparatus.

On the other hand, in the patent FR-A No. 1 113 966, a compressed air operated weapon was proposed, in which the valve and its spring were replaced by a valve consisting of a flap and a seal providing for circuit tightness. In operation, the seal moves inside its housing and is compressed between two stops. This results in a quicker wear of this seal and in a compressed gas consumption incompatible with the use of a standard reserve of compressed gas.

The aim of the present invention is to propose a feeding service equipped with a conventional valve, which includes no valve return spring and which can be used with a standard reserve of compressed gas.

Therefore, the object of the invention is a device intended to feed with compressed gas a weapon including a gas reserve, a valve moving inside its housing, and a valve seat located in this housing, holding and guiding the valve rod, wherein said device includes an expansion unit interposed between the gas reserve and the valve, consisting of a first expansion chamber communicating with the gas reserve and a second chamber communicating with the valve housing, both chambers being separated by a calibrated orifice.

The volume of the second chamber may be 5 to 7 times smaller than that of the first chamber.

Both chambers may consist of hollow cylindrical elements.

The cylinder which constitutes the second chamber may be engaged into the valve housing, its end constituting the valve stop so that the distance between the seat and the stop determines the valve stroke.

The expansion unit comprises a sleeve which supports a perforating needle intended to pierce the gas reserve, the said sleeve including an open cavity into which the needle protudes and intended to accommodate the collar of the gas reserve.

A two-lip hollow seal is located in the sleeve cavity, the first lip being brought to bear upon the cavity bottom and around the needle, and the second being brought to bear upon the gas reserve collar.

An advantage of the present invention is that the valve opening-closing cycle, as a function of time, has a square profile. So, the full opening and the full closing of the valve are quasi-instantaneous.

Another advantage lies in that the weapon can be used in a temperature range varying from −15° to +40° C., which is not possible with a spring-loaded valve.

Another advantage is the simplified assembly of the valve since it is no longer necessary to provide two bearing points for the conventional spring, one on the valve itself, the other on a fixed point of the weapon.

Another advantage is that the quantity of compressed gas delivered is approximately constant in operation, which does not change the ballistics of the weapon.

Other advantages of the invention will be better understood in the light of the following complementary description associated with the accompanying drawings

BRIEF DESCRIPTION OF THE DRAWINGS

FIG. 3 represents a cross-section of the valve utilized,

DETAILED DESCRIPTION OF THE PREFERRED EMBODIMENTS

Figure 1:
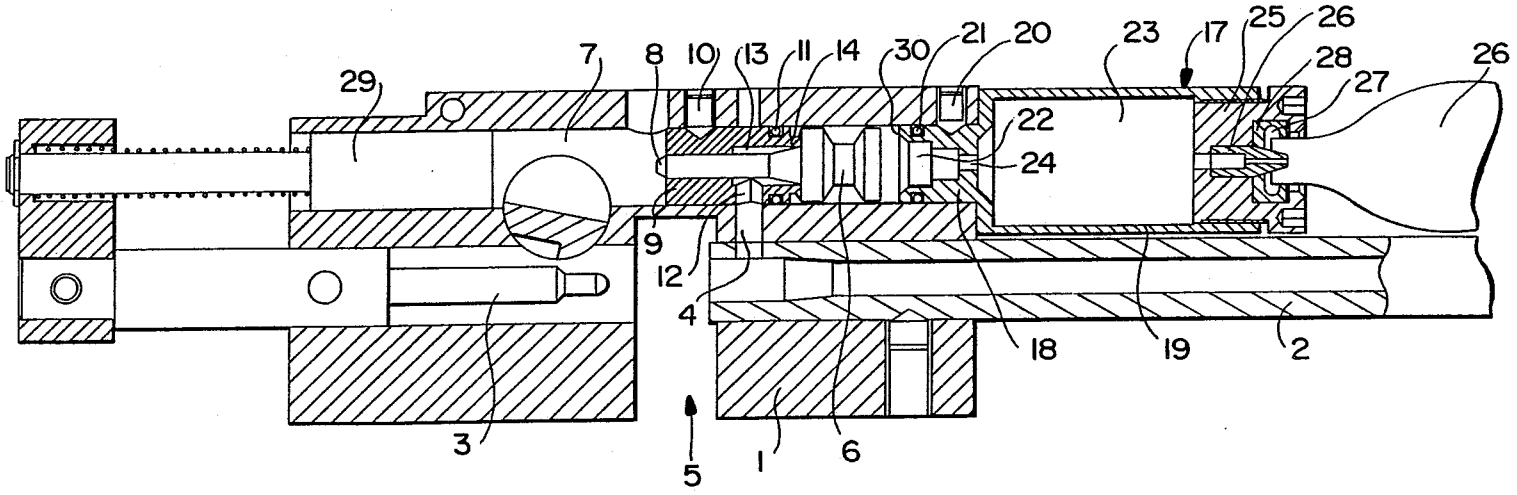
FIGS. 1 and 2 represent a cross-section of the gas feeding device in closed configuration and in open configuration respectively.
Figure 2:
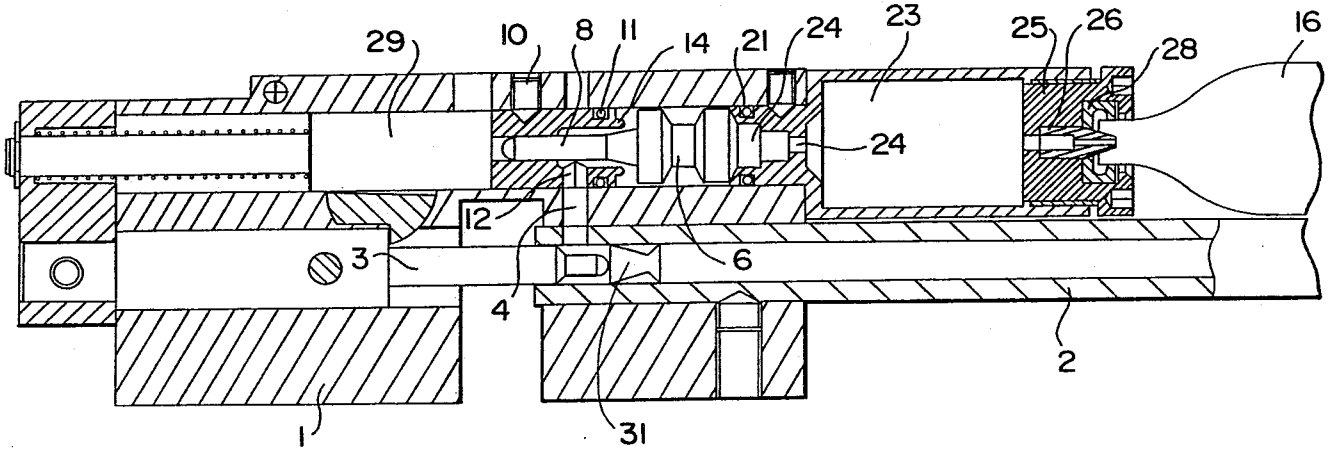
Figure 7:
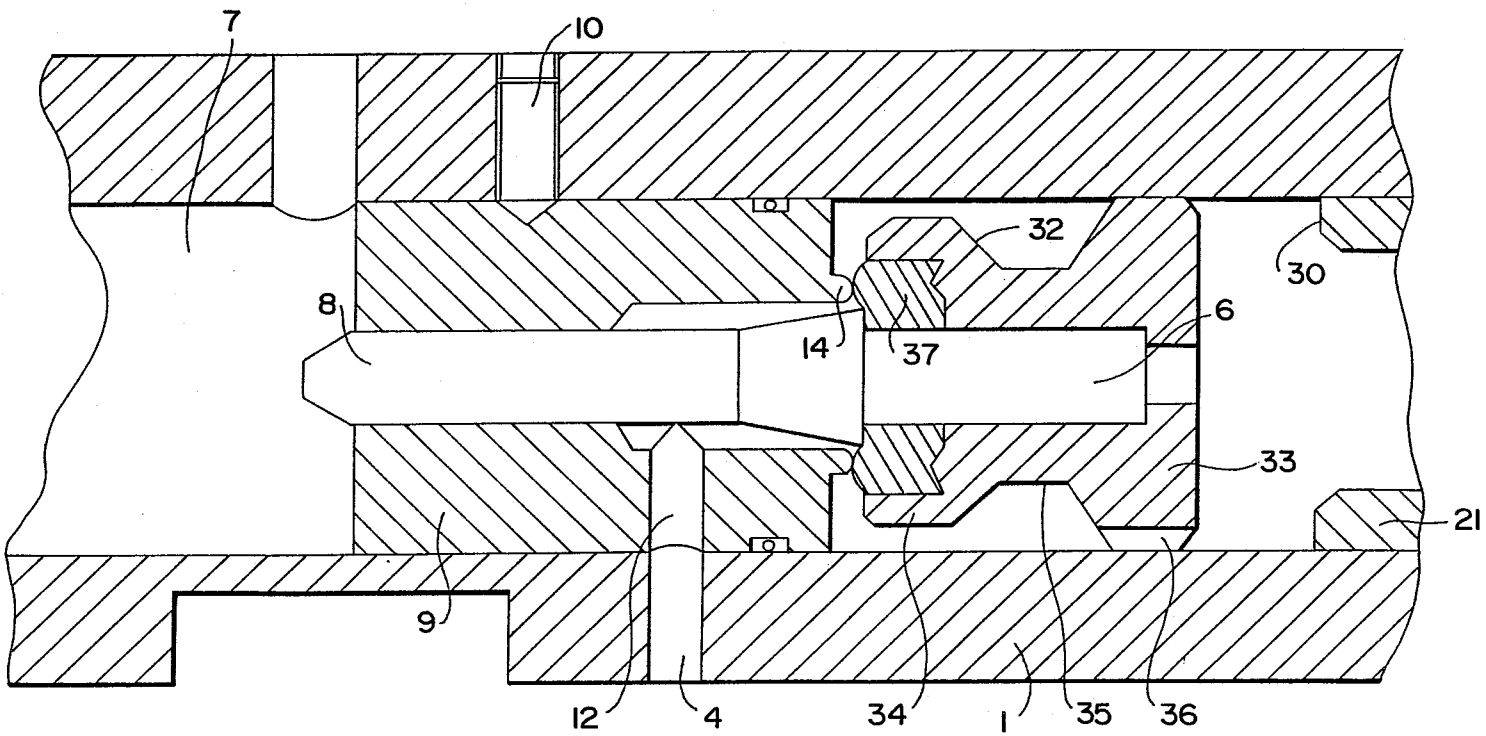

In FIGS. 1 and 2, we have shown a partial cross-section of a weapon as described in U.S. Pat. No. 4,602,608 including a body 1 accommodating a launch barrel 2, in which the projectiles are introduced in a well-known manner by means of a ramming piston 3 beyond a compressed gas inlet pipe 4. The projectiles can be distributed one by one by a magazine (not shown) engaged into a groove 5, and for further details one may refer to the U.S. patent mentioned above.

The weapon also includes a valve 6 sliding inside a housing 7 of the body, the rod 8 of which is guided by valve seat 9. This seat is secured by screw 10 and its tightness with respect to housing 7 is provided for by means of O-ring 11 located, on the figure, to the right of pipe 4. This seat also includes a pipe 12 extending beyond pipe 4 that projects into an axial through hole 13. Tightness between the valve and the seat is provided for by a seal located in the valve body and stop 14 constituted by the seat. The valve utilized is described in further detail hereinafter in association with FIG. 3.

The compressed gas is taken from a standard gas reserve 16, such as, for example, a bottle of 12 g of carbon dioxide compressed to $56.10^5$ Pa at normal temperature. This reserve is made integral with the weapon in a well-known manner.

Valve 6 is connected to bottle 16 through expansion unit 17 consisting of two roughly cylindrical hollow sections 18 and 19, of different diameters. Section 18, of a smaller diameter, is inserted into housing 7 and secured by screw 20. The tightness of this housing is provided for by O-ring 21. The two sections 18 and 19 delimit respective chambers 22 and 23 which communicate through calibrated orifice 24 which has a diameter of 3–5 mm and is sized to throttle the flow between the chambers 22 and 23. The free end of section 19 is closed by means of a screwed-bonded cylindrical sleeve 25. This lengthwise pierced sleeve is fitted with a perforation needle 26 and includes a cavity 27 intended to accommodate the collar of bottle 16. Needle 26 projects into this cavity and during the preparation for perforation of bottle 16 the latter is pressed against the needle by means of a lever (not represented) in order to cause the frangible disc of the bottle to be pierced. Cavity 27 accommodates a two-lip hollow seal, one lip of which is located at the bottom of the cavity and around needle 26 and the other at the level of the outer wall around the collar of bottle 16. This structure presents two advantages.

the hollow shape of the seal enables it to absorb the large variations in length of the bottles which cannot be compensated for by the perforating system, and in case of a leaky perforation the gas fills the lower cavity 27. The pressure obtained in this cavity increases with the leak and since seal 28 is captive, the tightening of the outer lip onto the bottle collar increases in proportion, thus ensuring self-tightness.

Lastly, valve 6 is actuated in a well-known manner, during the firing sequence, by a percussion hammer 29.

The operation is as follows: when bottle 16 is installed and perforated, the gas expands into the first expansion chamber 23 and then into the second expansion chamber 22. During this sudden gas expansion, valve 6 is brought to bear upon stop 14 of seat 9. Tightness is provided for and the weapon is ready to operate. The firing control consists conventionally of a trigger (not represented) which releases percussion hammer 29 once a projectile has been introduced into the barrel by ramming piston 3.

FIG. 2 represents a firing sequence after the percussion of rod 8 by hammer 29. The valve body is blocked by stop 30 consisting of the end of section 18. The distance between stops 14 and 30 determines the valve stroke. The impact of hammer 29 onto the valve results in a quick displacement of the valve the extreme position of which is represented schematically in FIG. 2. During this brief opening time, the required quantity of gas passes from chamber 22 through the holes pierced in the body of valve 6 (hereafter described in association with FIG. 3), the space temporarily freed between stop 14 and valve 6, through-hole 13 and lastly pipes 12 and 4. Projectile 31, present in the chamber, is then propelled outside of barrel 2. The return of valve 6 to its initial position is obtained through the combination of two forces: on the one hand, the reaction forces generated by the valve impact on stop 30 and, on the other hand, the gas pressure exerted on the valve body, which combine so as to bring the valve to bear instantaneously upon stop 14.

The tests conducted show that the volume of chamber 23 may range from 5 to 7 $cm^3$, that of chamber 22 being 5 to 7 times smaller. The diameter of hole 24 may range from 3 to 5 mm.

Lastly, it should be noted that even at extreme temperatures from $-15°$ C. to $+40°$ C., where the gas pressure varies from $20.10^5$ Pa to $76.10^5$ Pa, a satisfactory operation of the weapon is obtained. As a matter of fact, the pressure of the bottle-stored gases varies with the operating temperature, on the one hand, and with the number of shots fired, on the other. Each time a projectile is fired, a certain volume of gas is expanded which results physically in a production of kilogram calories. Then, chamber 23 provides an expansion volume which homogenizes the gas expansion after each shot fired and frangible disc 24 regulates the compressed gas exchange between chambers 22 and 23, since a pressure difference is created between them upon firing due to their volume difference.

Of course, hammer 29 and piston 3 are returned to their initial positions, in a well-known manner, as soon as the trigger is released and the weapon is then ready to fire another shot.

In FIG. 3, we have represented a cross-section of the valve assembly the rod 8 of which includes a shoulder and a cylindrical rear section. Body 32 is fitted with two cylindrical cheeks 33 and 34 separated by an annular rib 35. Cylindrical cheek 33 includes openings 36 intended for the passage of compressed gas. The diameter of cheek 33 corresponds to the inner diameter of housing 7 in which valve 6 is mounted as indicated, so that this valve can be moved by the compressed fluid acting upon the front face of cheek 33. The diameter of cheek 34 is preferably smaller than that of cheek 33. Body 32 includes a first taper hole prolonged by a second cylindrical flat-bottomed hole. The diameter of the second hole is determined so that the rear section of the rod is kept locked in order to join the body and the rod together by simply tightening them diametrically. The bottom of the first hole has a convex annular swelling and accommodates an axially-pierced O-ring 37.

The dimensions of seal 37, of the rear section of rod 8 and of the first hole are such that, when rod 8 is assembled with valve body 32, seal 37 is compressed axially and longitudinally which causes a slight swelling of the free area of the seal visible in this figure.

We have also represented in FIG. 3 housing 7 in which the valve is mounted and seat 9 which ensures the guidance of rod 8. The outer diameter of cheek 33 is approximately equal to the inner diameter of housing 7 so as to obtain a guidance of valve body 32 inside this housing. So, the valve is kept in place through rod 8 which slides inside seat 9 and through cheek 33 which slides inside housing 7. One should note the absence of a dynamic tightness at the location of the valve rod and also at the location of the head of the ramming piston 3 which enters into the barrel. Only a static tightness is achieved by identical O-rings 11 and 21 (see FIG. 1). Moreover, the operation of a weapon equipped with this valve is semi-automatic without any power draw from gas reserve 16, which would reduce its performance.

As stated above, cheek 33 is fitted with openings 36 pierced at its periphery, but these could be replaced by calibrated holes pierced through the thickness of cheek 33.

Figure 4:
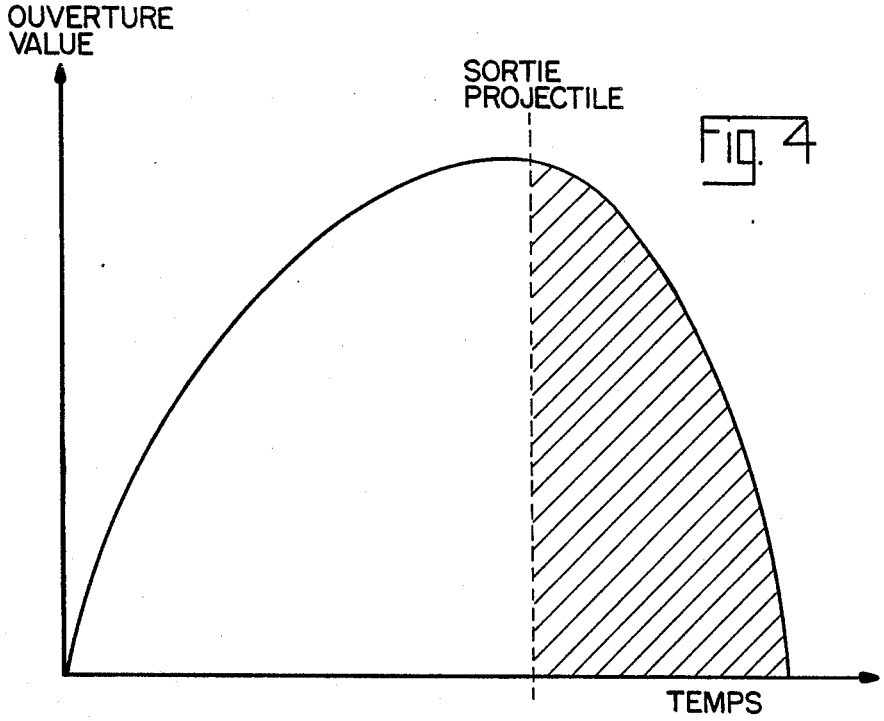
FIG. 4 represents the valve opening space-vs-time curve for a valve equipped with a return spring and FIG. 5 shows the same curve for a valve according to the invention.

In FIG. 4, we have represented the opening-closing cycle of a conventional valve equipped with a return spring. We known that, to provide for a quick closing of the valve, the percussion hammer has a low axial load when it comes in contact with the valve rod. It can be seen that the valve opening space-vs-time curve has a sinusoidal profile and that the projectile comes out at the peak of the curve. The cross-hatched area represents the volume of lost compressed gas which is not used for propelling the projectile.

Figure 5:
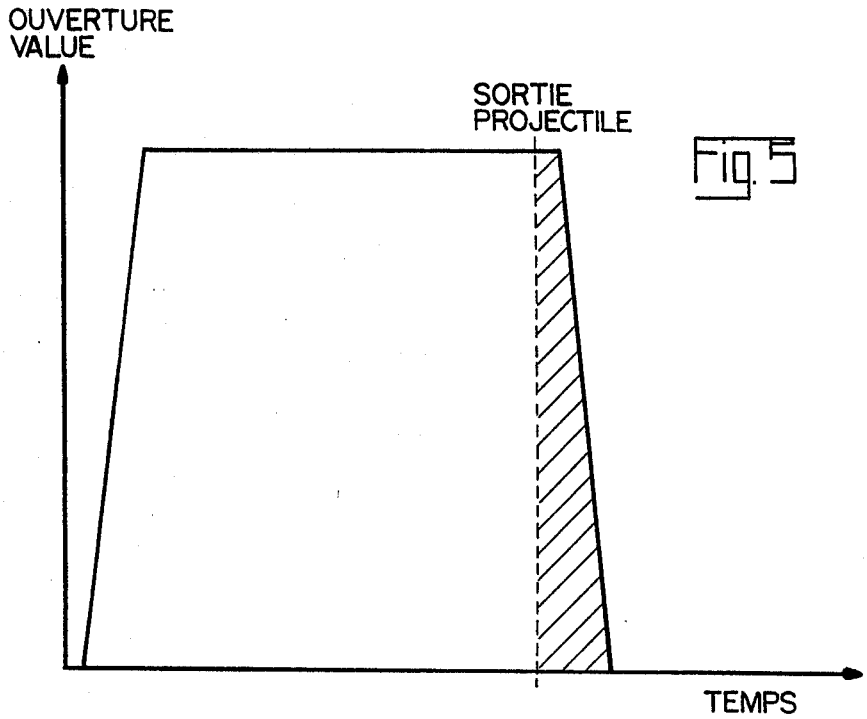

FIG. 5, represents the opening-closing cycle of the valve according to the invention. The valve is not returned to the closed position by a spring as it is the case with all weapons of this type. The shock in open position, due to the impact against face 30 located at a given distance from the end of valve rod 8 as in FIG. 3, causes the opening movement to stop and its direction to be reversed. It can be seen that the valve opening space-vs-time curve has a square profile and that the opening and closing are quasi-instantaneous. The cross-hatched area representing the volume of lost compressed gas is much smaller in this case. Therefore, the output is higher in regard to the time to released gas volume ratio than for a valve equipped with a return spring.

This configuration of the tightening valve, without spring, permits to optimize the weapon in order to obtain the best projectile velocity performancse which characterizes the accuracy and the range of the weapon as well as its self-containedness, i.e. the number of shots fired with a standard carbon dioxide reserve. To this design feature we must associate the volume of gas stored at the rear of the valve face, i.e. the volume of chamber 22, and the diameter of hole 24 used for communication between expansion chambers 23 and 24. These parameters have a direct influence on the opening-closing times; they contribute to the achievement of the space-time square cycle, thus to the optimization of the performance in terms of projectile velocity and bottle durability.

We claim:

1. A device intended to feed with compressed gas a weapon of the type which includes a gas reserve and a valve housing, an unbiased valve having a valve rod, said valve being freely axially movable inside a bore formed in said valve housing, and a valve seat located in the valve housing holding and guiding the valve and valve rod, said valve being engageable with the valve seat, wherein said device includes an expansion unit interposed between the gas reserve and the valve seat, said expansion unit comprising a first expansion chamber communicating with the gas reserve and a second chamber communicating with the bore, said first chamber being several times larger than the valve housing bore and said second chamber, the chambers being separated by a calibrated orifice, said orifice having a diameter less than the diameters of either of the first or second chambers, the first and second chambers and calibrated orifice cooperating with said valve to discharge a substantially constant quantity of gas for each opening of said valve.

2. A device as set forth in claim 1, wherein
the volume of said second chamber is smaller than that of said first chamber.

3. A device as set forth in claim 2, wherein
both chambers are delimited by hollow cylindrical elements.

4. A device as set forth in claim 3, wherein said cylindrical element includes said second chamber and is engaged into said valve housing, its end comprising a valve stop so that the distance between a seat stop of said seat and said valve stop determines the valve stroke.

5. A device as set forth in claim 4, wherein
the motive power providing for the valve closing consists of the reaction force generated by the impact of said valve onto said valve stop, on the one hand, and of the compressed gas pressure, on the other hand.

6. A device as set forth in claim 4, wherein
said volume of the first chamber ranges from 5 to 7 $cm^3$, the volume of said second chamber being 5 to 7 times smaller.

7. A device as set forth in claim 1, wherein
the diameter of said orifice ranges from 3 to 5 mm.

8. A device as set forth in claim 1, wherein said expansion unit includes a sleeve supporting a perforating needle intended to pierce the gas reserve, said sleeve including an open cavity into which said needle protrudes, and intended to accommodate the collar of the gas reserve.

9. A device as set forth in claim 8, further providing a two-lip hollow seal located in said cavity of said sleeve, the first lip being brought to bear upon said gas reserve collar.

* * * * *